US010132480B2

(12) United States Patent
Ghasabi

(10) Patent No.: US 10,132,480 B2
(45) Date of Patent: Nov. 20, 2018

(54) LANDSCAPE LIGHT

(71) Applicant: LUMINIZ INC., Etobicoke (CA)

(72) Inventor: Amir Ghasabi, Etobicoke (CA)

(73) Assignee: LUMINIZ INC., Etobicoke (CA)

( * ) Notice: Subject to any disclaimer, the term of this patent is extended or adjusted under 35 U.S.C. 154(b) by 0 days.

(21) Appl. No.: 15/230,798

(22) Filed: Aug. 8, 2016

(65) Prior Publication Data

US 2017/0045212 A1 Feb. 16, 2017

(30) Foreign Application Priority Data

Aug. 14, 2015 (CA) ..... 2900378

(51) Int. Cl.

| | |
|---|---|
| ***F21V 21/30*** | (2006.01) |
| ***F21S 8/08*** | (2006.01) |
| ***F21V 23/00*** | (2015.01) |
| ***F21V 29/77*** | (2015.01) |
| ***F21V 21/08*** | (2006.01) |
| ***F21V 1/00*** | (2006.01) |
| ***F21V 17/00*** | (2006.01) |
| *F21Y 115/10* | (2016.01) |

(52) U.S. Cl.

CPC ..... *F21V 21/30* (2013.01); *F21S 8/081* (2013.01); *F21V 1/00* (2013.01); *F21V 17/002* (2013.01); *F21V 21/0824* (2013.01); *F21V 23/002* (2013.01); *F21V 29/773* (2015.01); *F21Y 2115/10* (2016.08)

(58) Field of Classification Search

CPC ..... F21V 21/06; F21V 21/0824; F21V 21/08; F21V 21/30; F21W 2131/109; F21S 8/081; F21S 8/08

See application file for complete search history.

(56) References Cited

U.S. PATENT DOCUMENTS

| | | | |
|---|---|---|---|
| D306,396 | S | 3/1990 | Brushaber |
| D312,566 | S | 12/1990 | Scherer |
| D395,996 | S | 7/1998 | Fischer |

(Continued)

OTHER PUBLICATIONS

Requirement for Restriction/Election dated Oct. 5, 2016 for U.S. Appl. No. 29/528,209.

(Continued)

*Primary Examiner* — Mariceli Santiago
(74) *Attorney, Agent, or Firm* — Bereskin & Parr LLP/S.E.N.C.R.L., s.rl.; Isis E. Caulder

(57) ABSTRACT

A landscape light is provided, which comprises a support, a head, an adaptor, and a fastener. The support is for securing the landscape light to a substrate. The head comprises a body, a light source for emitting light along a direction of light emission, a cover, and a first adjustment member secured to the body. The adaptor comprises a second adjustment member secured to a stem. The stem is removably securable to the support, and is shaped and sized to be removably securable to the support and to one or more other supports for securing the landscape light to one or more other types of different substrates. The second adjustment member is removably securable to the first adjustment member in a plurality of positions for adjusting a tilt angle between the head and the support. The fastener is for removably fastening the first adjustment member to the second adjustment member.

16 Claims, 5 Drawing Sheets

(56) References Cited

U.S. PATENT DOCUMENTS

| | | | | |
|---|---|---|---|---|
| D433,616 | S | 11/2000 | Fischer | |
| 7,367,740 | B2 | 5/2008 | Lazic et al. | |
| D640,125 | S | 6/2011 | Rosenkranz et al. | |
| D658,480 | S | 5/2012 | Pratt | |
| D659,871 | S | 5/2012 | Lee et al. | |
| D667,159 | S | 9/2012 | Wauters | |
| D712,487 | S | 9/2014 | Strand | |
| D735,923 | S | 8/2015 | Helms et al. | |
| D742,731 | S | 11/2015 | Zedan et al. | |
| D750,475 | S | 3/2016 | Bucher | |
| D777,965 | S | 1/2017 | Michandani | |
| D779,098 | S | 2/2017 | Tsai | |
| 2002/0101571 | A1* | 8/2002 | Panasewicz | F21V 21/0824 353/119 |
| 2009/0185377 | A1* | 7/2009 | Johnson | F21V 21/0824 362/259 |
| 2011/0002122 | A1* | 1/2011 | Tsao | F21S 8/033 362/277 |
| 2015/0260385 | A1* | 9/2015 | Brynjolfsson | F21V 23/045 315/152 |

OTHER PUBLICATIONS

Notice of Allowance and Fee(s) Due dated Mar. 9, 2017 for U.S. Appl. No. 29/528,209.

Malibu Low Voltage 50-Watt Black Flood Light-8301-9601-01—The Home Depot—http://www.homedepot.com/p/Malibu-Low-Voltage-50-Watt-Black-Flood-Light-8301-9601-01/202025736?N=5yc1vZc7qwZyhZ1z0u658 [retrieved on Mar. 16, 2015].

Malibu Low Voltage LED Black 50W Equivalent Flood Light-8401-2650-01—The Home Depot—http://www.homedepot.com/p/Malibu-Low-Voltage-LED-Black-50W-Equivalent-Flood-Light-8401-2650-01/203196540 [retrieved on Mar. 16, 2015].

* cited by examiner

LANDSCAPE LIGHT

CROSS-REFERENCE TO RELATED APPLICATION

This application claims priority from Canadian Patent Application No. 2,900,378, filed on Aug. 14, 2015, which is incorporated herein by reference in its entirety.

FIELD

This invention relates to landscape lights, and in particular to landscape lights having a light generating module connected to a support.

BACKGROUND

Landscape lights are used in landscapes to illuminate different elements of that landscape such as plants or other structures. Landscape lights can be installed indoors or outdoors in different substrates such as loose, unpaved earth, concrete, stone, or wood. Some landscape light designs include a light generating module connected to a support.

The support secures the landscape light to a substrate. In some cases, supports are secured to the substrate during the construction phase of the landscape. These permanently secured supports and landscape lights are susceptible to damage during the construction phase of the landscape.

In addition, different areas of a landscape may comprise different substrates. For example, turf can comprise loose dirt, whereas paved or structural components of a landscape may have concrete, stone, or wood substrates. A different support may be required to secure the landscape light in each of these different types of substrates.

SUMMARY

According to an embodiment of the present invention, there is provided a landscape light comprising a support, a head, an adaptor, and a fastener. The support is for securing the landscape light to a substrate. The head comprises a body, a light source, a cover, and a first adjustment member secured to the body. The light source is secured to the body, and is for emitting light along a direction of light emission. The cover is secured to the body, and is for covering the light source and allowing transmission of at least a portion of a light generated by the light source. The adaptor comprises a stem and a second adjustment member secured to the stem. The stem is removably securable to the support, and is shaped and sized to be removably securable to the support and to one or more other supports for securing the landscape light to one or more other types of substrates different from the substrate. The second adjustment member is secured to the stem, and is removably securable to the first adjustment member in a plurality of positions for adjusting a tilt angle between the head and the support, each of the plurality of positions corresponding to a different tilt angle between the head and the support. The fastener is for removably fastening the first adjustment member to the second adjustment member at each of the plurality of positions.

The first adjustment member can comprise a first set of teeth arranged along a first arc of a first circle of a given radius, the first circle defining a first plane about parallel to the direction of light emission, and the first set of teeth extending in a first direction about perpendicular to the direction of light emission. The second adjustment member can comprise a second set of teeth arranged along a second arc of a second circle of the given radius, the second circle defining a second plane about parallel to a longitudinal axis of the stem, and the second set of teeth extending in a second direction about perpendicular to the longitudinal axis of the stem. The first set of teeth can be for matingly engaging the second set of teeth at each of the plurality of positions, the first arc overlying at least a portion of the second arc during the mating engagement.

The fastener can comprise a screw. The first adjustment member can define an adjustment member cavity positioned at about a center of the first circle and opening in the first direction, the adjustment member cavity being threaded for matingly receiving the screw. The second adjustment member can define an aperture positioned at about a center of the second circle, the aperture for allowing passage of the screw.

The stem can comprise a threaded end. The support can define a support cavity being threaded, the support cavity for matingly receiving the threaded end of the stem for removably securing the adaptor to the support.

The support can comprise a spike for being driven under pressure into the substrate, the spike shaped to secure the support in the substrate.

The support can comprise an anchor for being embedded into a hardenable substrate of hardenable material having a soft state and a hardened state while the hardenable substrate is in the soft state. The anchor can be shaped to permanently secure the support in the hardenable substrate after the hardenable substrate achieves the hardened state.

The support can comprise a base securable to the substrate using a fastener.

The landscape light can further comprise a wire for connecting the light source to a power source external to the landscape light, and the stem can comprise a hollow core for allowing passage of the wire.

The landscape light can further comprise a wire for connecting the light source to a power source external to the landscape light, and the support can comprise a passage for allowing passage of the wire.

The light source can comprise one or more light emitting diodes.

The body can comprise a heat sink for dissipating heat generated by the light source into an environment external to the landscape light.

The heat sink can comprise a plurality of fins about parallel to the direction of light emission, the plurality of fins formed integrally with the body.

The landscape light can further comprise a hat securable to the body, the hat for shaping the light emitted by the light source by blocking propagation of the light radially to the direction of light emission, the blocking being asymmetrical about the direction of light emission.

According to another embodiment of the present invention, there is provided a landscape light kit comprising a support, a head, an adaptor, a fastener, and any two or more of a spike support, an embeddable support, and a fastenable support. The support is for securing the landscape light to a substrate. The head comprises a body, a light source, a cover, and a first adjustment member secured to the body. The light source is secured to the body, and is for emitting light along a direction of light emission. The cover is secured to the body, and is for covering the light source and allowing transmission of at least a portion of a light generated by the light source. The adaptor comprises a stem and a second adjustment member secured to the stem. The stem is removably securable to the support, and is shaped and sized to be removably securable to the support and to one or more other supports for securing the landscape light to one or more other types of substrates different from the substrate. The second adjustment member is secured to the stem, and is removably securable to the first adjustment member in a plurality of positions for adjusting a tilt angle between the head and the support, each of the plurality of positions corresponding to a different tilt angle between the head and the support. The fastener is for removably fastening the first adjustment member to the second adjustment member at each of the plurality of positions. The spike support comprises a spike for being driven under pressure into the substrate, the spike shaped to secure the support in the substrate. The embeddable support comprises an anchor for being embedded into a hardenable substrate of hardenable material having a soft state and a hardened state while the hardenable substrate is in the soft state, the anchor shaped to permanently secure the support in the hardenable substrate after the hardenable substrate achieves the hardened state. The fastenable support comprises a base securable to the substrate using a fastener.

The landscape light kit can further comprise a hat securable to the body, the hat for shaping the light emitted by the light source by blocking propagation of the light radially to the direction of light emission, the blocking being asymmetrical about the direction of light emission.

BRIEF DESCRIPTION OF THE DRAWINGS

Embodiments of the present invention will now be described, by way of example only, with reference to the attached Figures.

DETAILED DESCRIPTION

Figure 1:
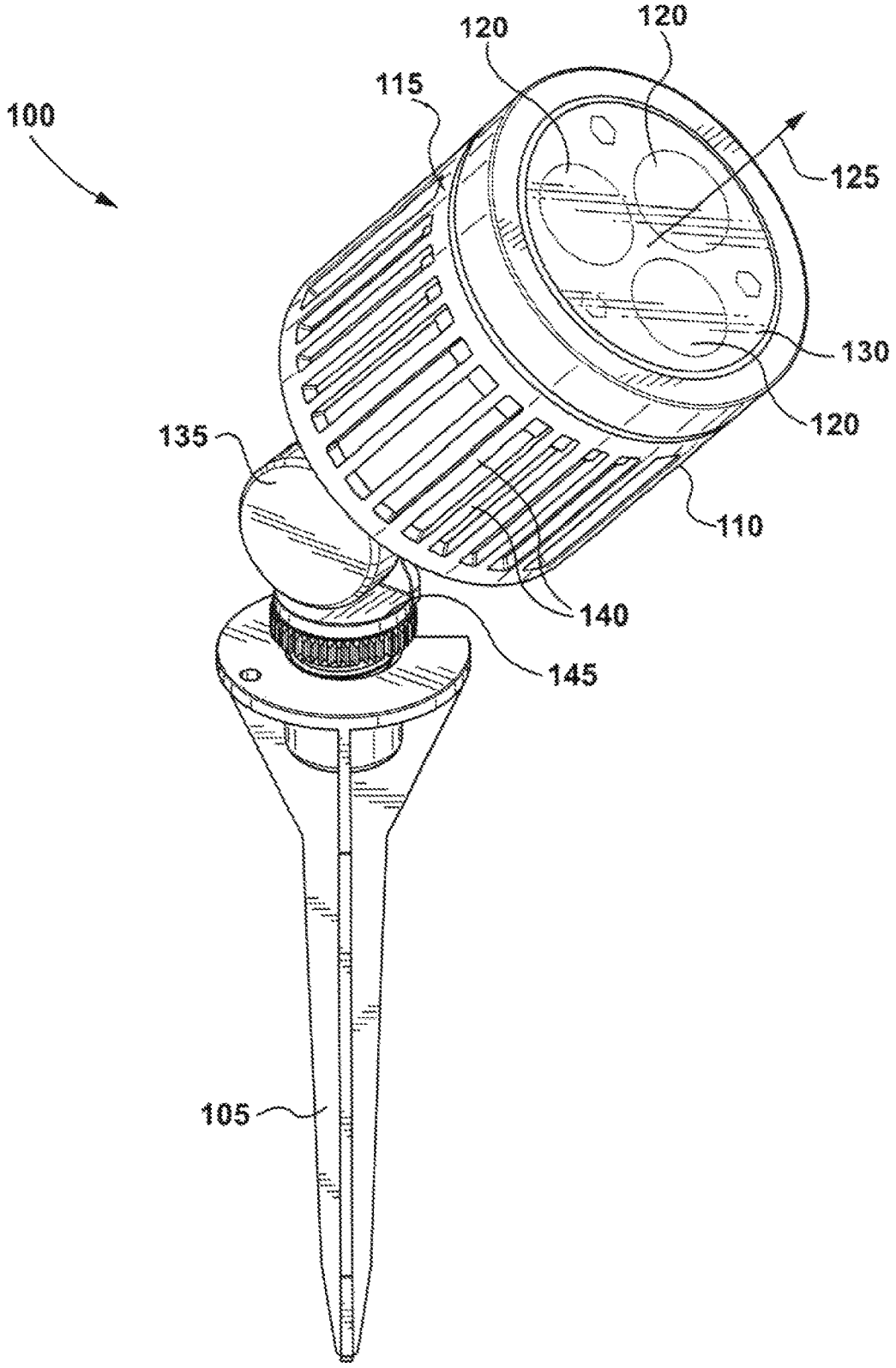
FIG. 1 shows a top perspective view of an example embedment of the landscape light.

FIG. 1 shows a top perspective view of landscape light 100, which comprises a support 105, a head 110, and an adaptor 145 connecting head 110 to support 105. Support 105 can be used to secure landscape light 100 to a substrate, including but not limited to, unpaved earth. As will be described below in greater detail, in different configurations different supports can be connected to head 110 to allow securing the landscape light to different substrates such as wood, stone, and concrete.

Head 110 comprises a body 115, and a light source 120 secured to body 115. In landscape light 100, body 115 is generally cylindrical in shape and light source 120 is housed inside body 115. However, the shape and configuration of body 115 and light source 120 are not limiting, and different shapes and configurations can be used. Light source 120 emits light generally along a direction of light emission 125. Light source 120 can be an electrical light source. Light source 120 can comprise one or more light emitting diodes (LEDs), fluorescent lights, incandescent lights, halogen lights, and/or laser lights, or other suitable light sources. Head 110 also comprises a cover 130 secured to body 115, to cover light source 120 and allow transmission of at least a portion of the light generated by light source 120 out of head 110 in the direction of light emission 125. Cover 130 can be colorless or colored. Cover 130 can be completely or partially transparent or translucent. Cover 130 can be uniform or can be patterned.

Head 110 also comprises a first adjustment member 135 secured to body 115. In landscape light 100, first adjustment member 135 is integrally formed with body 115. In other embodiments, first adjustment member 135 can be secured to body 115 using a fastener or other suitable means. Body 115 can comprise a heat sink for dissipating heat generated by light source 120 into an environment external to landscape light 100, such as air. The heat sink can comprise a plurality of fins 140 oriented about parallel to the direction of light emission 125. Fins 140 can be formed integrally with body 115.

Figure 2:
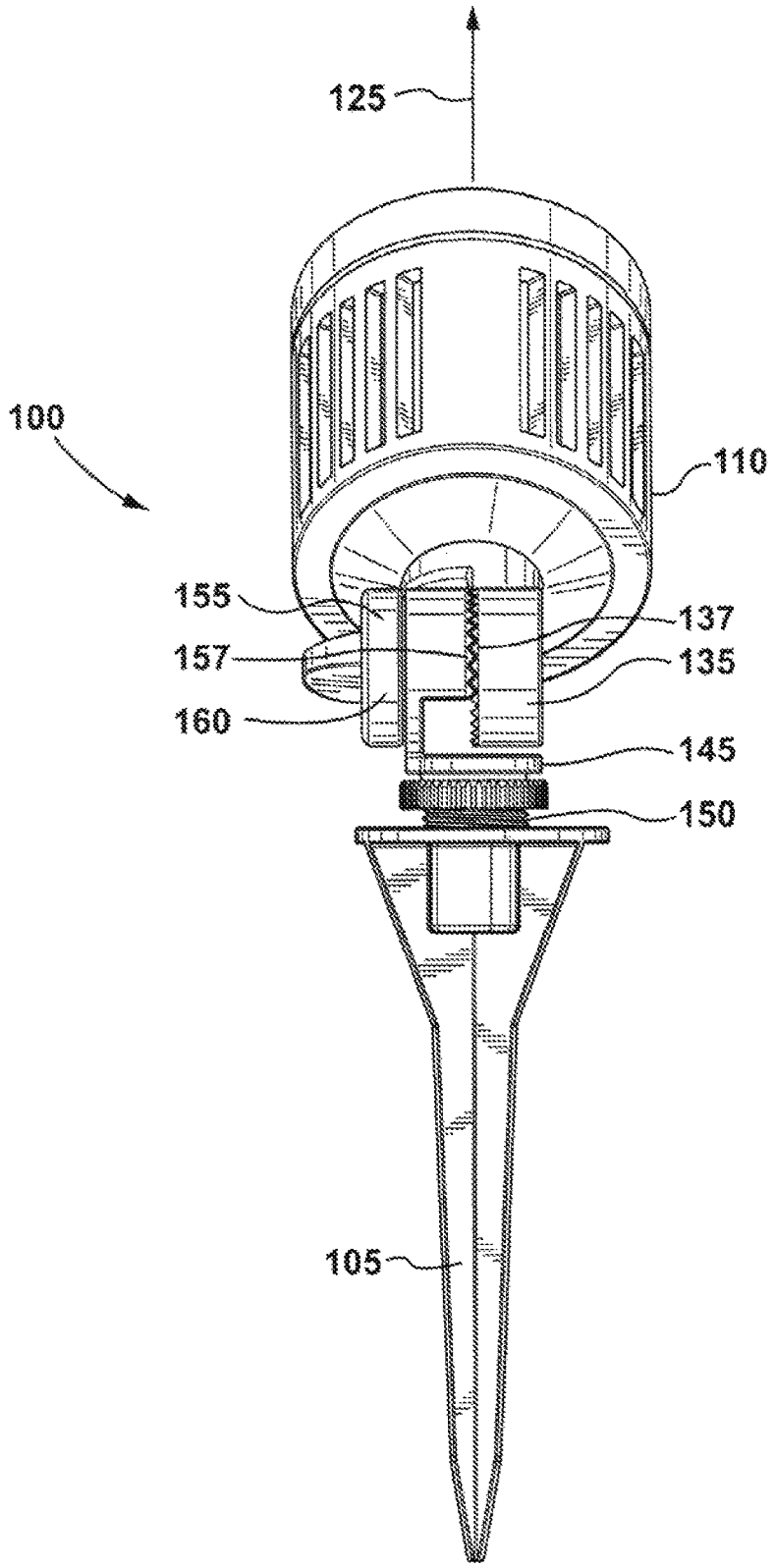
FIG. 2 shows a rear elevation view of the landscape light of FIG. 1.
Figure 5:
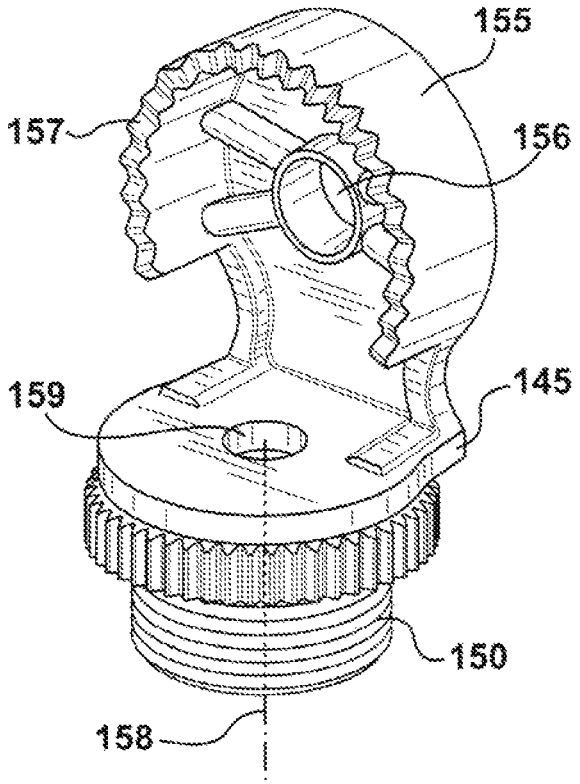
FIG. 5 shows a top perspective view of an example embodiment of the adaptor.

Turning now to FIGS. 2 and 5, adaptor 145 comprises a stem 150, which is removably securable to support 105. Stem 150 is shaped and sized to be removably securable to one or more other supports different than support 105. The other supports can in turn be used to secure landscape light 100 to substrates different than the substrate to which support 105 can be secured.

Figure 4:
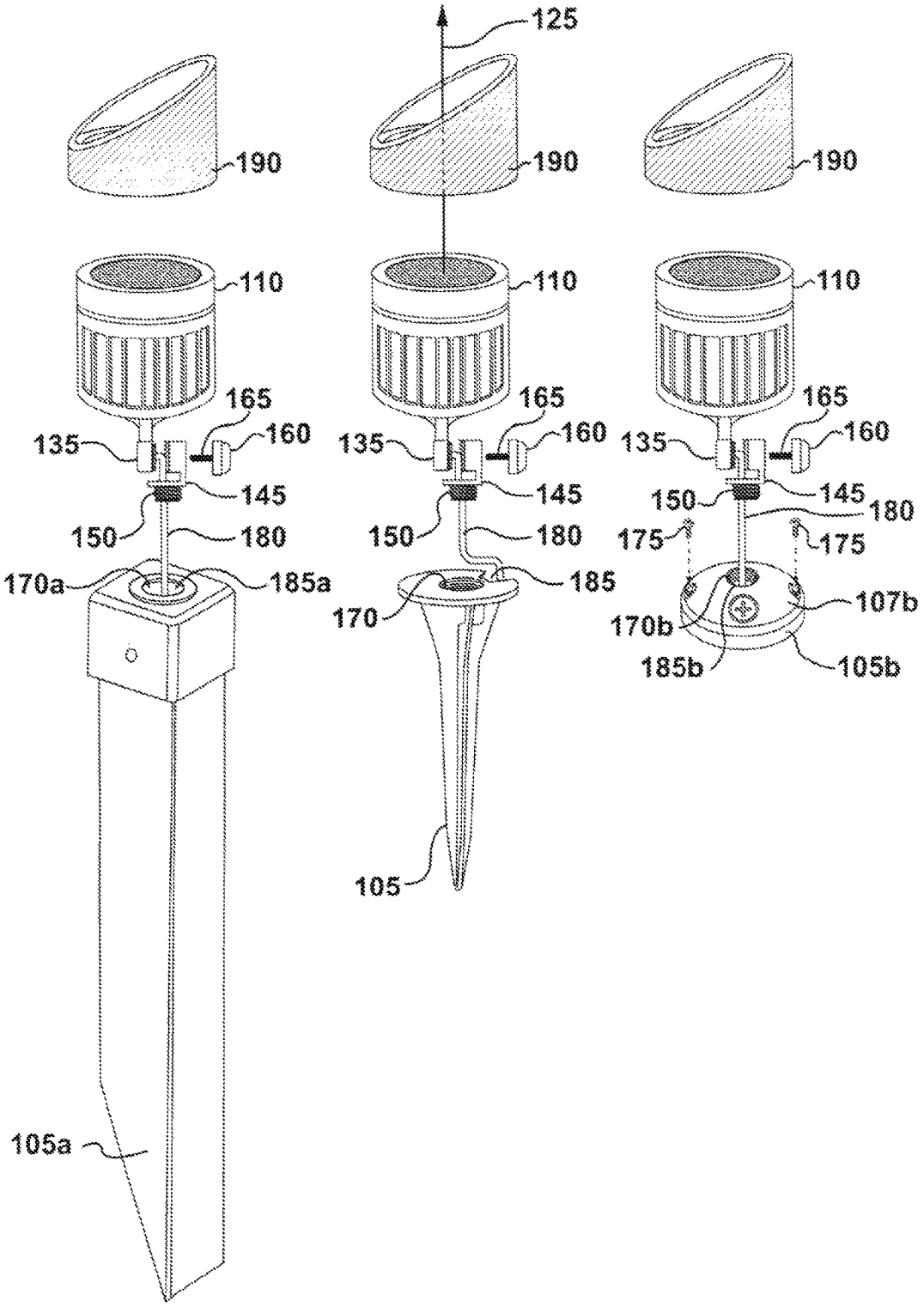
FIG. 4 shows partially-exploded top perspective views of the landscape light of FIG. 1 and two other configurations with different supports.

For example, FIG. 4 shows three different configurations of the landscape light where the same head 110 and adaptor 145 are connectable to three different supports: a spike type support 105 for being driven under pressure into a substrate such as unpaved earth to secure support 105 into the substrate; a large spike 105*a*, which can be used to support larger and/or heavier heads or to secure the landscape light in looser dirt in a manner similar to support 105; and a fastenable support 105*b*, which comprises a base 107*b* securable to a substrate such as wood, concrete, or stone using fasteners such as screws 175.

Another example of a type of support is an embeddable support (not shown separately) which can comprise an anchor for being embedded into a hardenable substrate comprising a hardenable material having a soft state and a hardened state. Examples of such a hardenable material include concrete, resins, and polymers. The embeddable support and/or anchor can be embedded in the hardenable material while the hardenable material is in its soft state. Once the hardenable material hardens to achieve its hardened state, the anchor and/or support can permanently secure the support to the hardenable substrate. Support 105, large spike 105*a*, and fastenable support 105*b* can all be used as an embeddable support. In some embodiments, the anchor of the embeddable support can be shaped and sized to permanently secure the embeddable support in the hardenable substrate by resisting the support being pulled out of the hardenable substrate after the hardenable substrate achieves its hardened state. Such a shape can include a support having an enlarged portion distal from its point of attachment to adaptor 145. This enlarged portion can be embedded in the hardenable substrate. Another example of such a shape can include a support that is curved or bent along the portion of its length that is inserted in the hardenable substrate.

As shown in FIGS. 2, 4, and 5, stem 150 can comprise a threaded end, bearing for example, spiral threading. Support 105 and fastenable support 105*b* can define a support cavity 170, 170*b* respectively, which can have a threaded surface complementary to that of stem 150, for matingly receiving the threaded end of stem 150 to removably secure adaptor 145 to support 105 or fastenable support 105*b*, respectively. Although not depicted, support cavity 170*a* can also have a threaded surface similar to those of support cavity 170, 170*b*. Other suitable means of removably securing adaptor 145 to support 105 known in the art can also be used.

The connection means between stem 150 of adaptor 145 and different types of supports can be standardized so that stem 150 can be removably secured to any one of support 105, large spike 105*a* support, fasten able support 105*b*, embeddable support, and any other type of support. In some embodiments, stem 150 can have a standardized threaded end of about ½ inch (1.27 cm) diameter. In other embodiments, stem 150 can have a standardized threaded end of about ¾ inch (1.91 cm) diameter.

Figure 3:
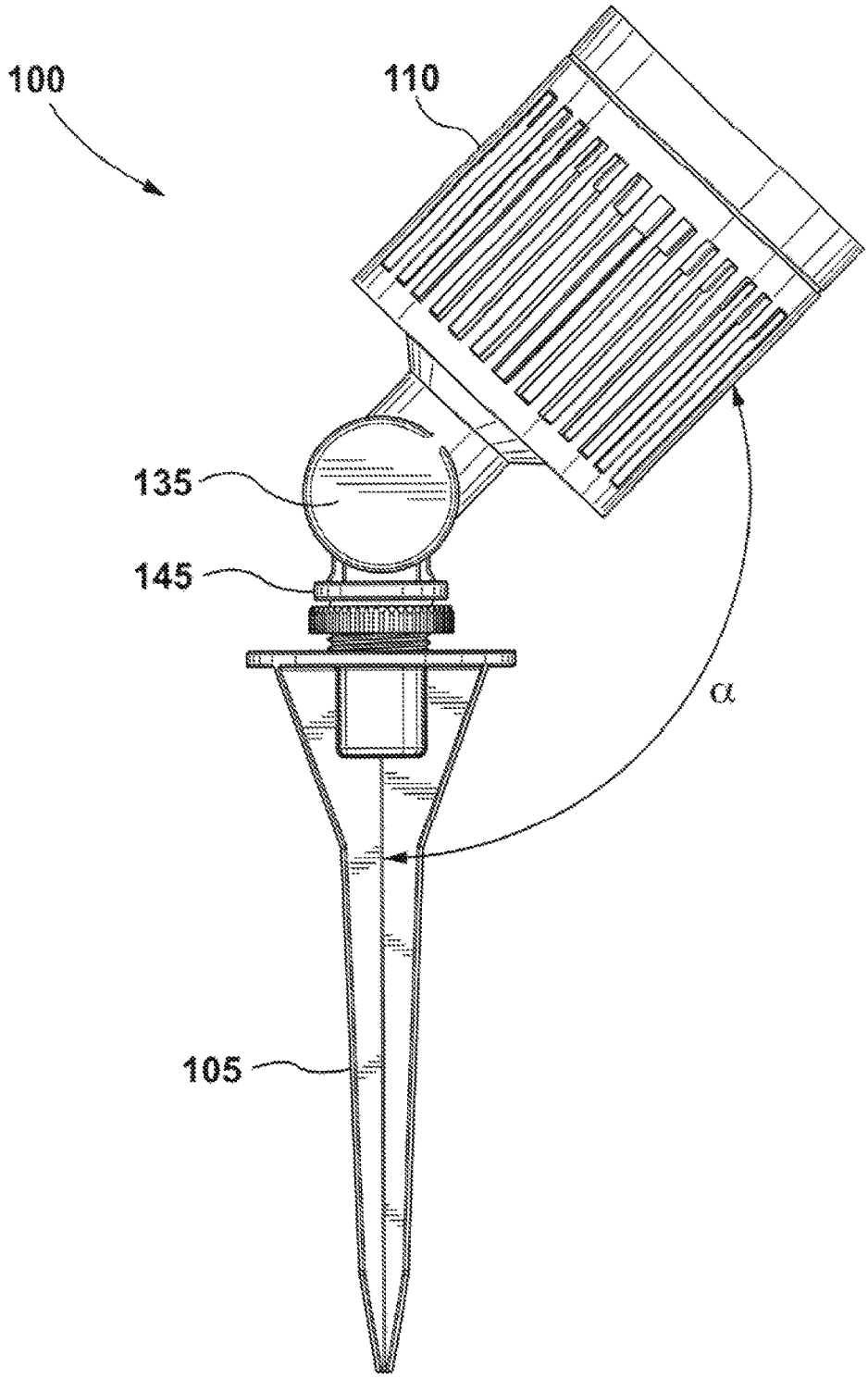
FIG. 3 shows a side elevation view of the landscape light of FIG. 1.

Returning to FIGS. 2 and 5, adaptor 145 also comprises a second adjustment member 155 secured to stem 150. In FIGS. 2 and 5, second adjustment member 155 and stem 150 are integrally formed. In other embodiments, second adjustment member 165 can be secured to stem 150 by methods including but not limited to welding and using a fastener. Second adjustment member 155 is removably securable to first adjustment member 135 in a plurality of positions for adjusting tilt angle α (shown in FIG. 3) between head 110 and support 105. Each of the plurality of positions corresponds to a different tilt angle α between head 110 and support 105. For example, FIGS. 1-3 show landscape light 100 at a tilt angle α between 90° and 180°. Tilt angle α can be adjustable and cm be greater than about 0° and less than about 360°.

As shown in FIGS. 2 and 4, a fastener 160 can be used to removably fasten first adjustment member 135 to second adjustment member 155 at each of the plurality of positions. In landscape light 100, to adjust tilt angle α, fastener 160 is loosened, first adjustment member 135 and second adjustment member 155 are adjusted relative to one another to engage one another to define a new tilt angle, and then fastener 160 is tightened to secure first adjustment member 135 to second adjustment member 155 and secure head 110 to support 105 at the new title angle. Other means of adjustably securing first adjustment member 135 to second adjustment member 155 can be used.

Referring to FIGS. 1-3, first adjustment member 135 can comprise a first set of teeth 137 arranged along a first arc of a first circle of a given radius. The first arc can extend around the full circumference of the first circle. The first circle defines a first plane about parallel to the direction of light emission 125, and the first set of teeth 137 can extend in a first direction about perpendicular to the direction of light emission 125. Second adjustment member 155 can comprise a second set of teeth 157 arranged along a second arc of a second circle of about the same radius as the first circle. The second circle can define a second plane about parallel to a longitudinal axis 158 (shown in FIG. 5) of stem 150, and the second set of teeth 157 can extend in a second direction about perpendicular to the longitudinal axis 158 of stem 150.

The first set of teeth 137 can matingly engage at least a portion of the second set of teeth 157 at each of the plurality of positions and tilt angles α, such that the first arc overlays at least a portion of the second arc during the mating engagement. The size and spacing of the teeth can determine increment of adjustments that can be made to tilt angle α: the larger the teeth and/or the spacing between the teeth of each set of teeth, the larger will be the smallest possible incremental change to tilt angle α.

As shown in FIG. 4, fastener 160 can comprise a screw 165, which can have spiral threading on its outer surface. First adjustment member 135 can define an adjustment member cavity (not visible in the Figs.) positioned at about the center of the first circle along an arc of which the first set of teeth 137 are arranged. The adjustment member cavity can open in the same direction as the first set of teeth 137 extend. The adjustment member cavity can be spirally threaded on its surface for matingly receiving screw 165.

As shown in FIG. 5, second adjustment member 155 can define an aperture 156 positioned at about the center of the second circle along an arc of which the second set of teeth 157 are arranged. Aperture 156 can be sized to allow passage of screw 165. To secure the first adjustment member 135 to the second adjustment member 155 at the given position defined by a desired tilt angle α, screw 165 is passed through aperture 156 and received inside the adjustment member cavity of the first adjustment member 135. Then the first set of teeth 137 are made to matingly engage the second set of teeth 157 at the desired tilt angle α. Then fastener 160 is tightened by tightening screw 165 press second adjustment member 155 against first adjustment member 135 to secure first adjustment member 135 to second adjustment member 155, thereby securing head 110 to support 105 at tilt angle α. Screw 165 defines the vertex of tilt angle α. In other embodiments, the adjustment member cavity can be part of the second adjustment member 155, and aperture 156 can be in the first adjustment member 135 instead of being in the second adjustment member 155.

As shown in FIGS. 4 and 5, landscape light 100 can comprise a wire 180 for connecting light source 120 to a power source external to landscape light 100. Adaptor 145 can have an opening 159 connected to a conduit (not visible in the Figs.) in stem 150. This conduit can be formed by a hollow core of stem 150. Wire 180 can pass into opening 159 and through the hollow core of stem 150 towards support 105. Support 105 can have a passage 185 to accommodate and allow for passage of wire 180. Passage 185 can take the form of a cut-out from a portion of support 105. When large spike 105*a* is used as the support, passage 185*a* can take the form of a conduit extending from support cavity 170*a* into and through large spike 105*a*, for passage of wire 180. Similarly, when fastenable support 105*b* is used as the support, passage 185*b* can take the form of a conduit extending from support cavity 170*b* into and through fastenable support 105*b*, for passage of wire 180.

As shown in FIG. 4, landscape light 100 can have a hat 190 securable to body 115 for shaping the light emitted by light source 120. Hat 190 can shape the emitted light by blocking propagation of the light radially to the direction of light emission 125, with the blocking being asymmetrical about the direction of light emission 125. Since one long side of hat 190 extends further from body 115 than the opposite shorter side, the light can propagate radially past the end of the short side in a first radial direction, whereas the light would be blocked from propagating radially by the long side in a second radial direction opposite the first radial direction. In this way, the blocking of the radial propagation of the light is asymmetrical about the direction of light emission 125. Other shapes and configurations of hats can be used to shape the fight emitted by light source 120.

As shown in FIG. 4, since stem 150 can be removably secured to a variety of supports, landscape light 100 can be provided in a kit, where different supports are provided for being attached to and used with the same head 110 and adaptor 145. The kit can include head 110, adaptor 145, fastener 160, and any two or more of support types including spike type support 105, large spike 105*a*, fastenable support 105*b*, and an embeddable support. The kit can also include hat 190, quick connectors or other rapid electrical connection means for connecting landscape light 100 to a power source external to K and instructions for installation and/or wiring of landscape light 100.

In constructing some landscapes, the position of the landscape light in the landscape is determined and the attachment of the landscape light to its substrate is effected during the construction phase. In such cases, having support 105 being removable from head 110 and adaptor 145 allows for securing support 105 in its substrate during the construction phase and attaching adaptor 145 and head 110 near the end or after the completion of lie construction phase. In this manner, the adaptor and the head can be protected from possible damage during the construction phase.

In addition, since adaptor 145 can have intricate components such as second set of teeth 157 to allow for adjustment of tilt angle α, it can be vulnerable to damage during the construction phase. It is possible to detach head 110 of landscape light 100 from the remaining components by unfastening fastener 160 and separating first adjustment member 135 from second adjustment member 155. However, such a detachment would leave adaptor 145, and its intricate components, with the support and exposed to the risk of damage during the construction/installation phase. For example, when the support is an embeddable support being embedded in concrete, concrete residue can contaminate the second set of teeth 157 and interfere with the functioning of adaptor 145. In addition, physical impact with construction workers and equipment can also damage adaptor 145.

In contrast, detaching head 110 from support 105 by detaching stem 150 from support 105 allows for keeping the intricate adaptor 145 with head 110, and leaving only the sturdier support 105 exposed during the construction phase. In addition, if any damage occurs, only support 105 has to be replaced instead of having to replace both adaptor 145 and support 105.

Furthermore, since stem 150 can removably attach to a plurality of different supports, as shown in FIG. 4, landscape light can be assembled by connecting the same head 110 and adaptor 145 to whichever type of support is best suitable for the substrate in which the landscape light must be installed. This reduces the need for suppliers and installers to keep in inventory a large number of landscape light units, each having a head, an adaptor, and a support, but differing from others only in the type of support. Instead, only the necessary varieties of supports can be stocked in inventory or transported on an installation cite, with each of the support varieties being removably attachable to, i.e. interoperable with, stem 150 to attach the same standard adaptor 145 and head 110 to each of the varieties of support types.

The above-described embodiments of the invention are intended to be examples of the present invention and alterations and modifications may be effected thereto, by those of skill in the art. The scope of the claims should not be limited by the exemplified embodiments described above, but should be given the broadest interpretation consistent with the specification and drawings as a whole.

The invention claimed is:

1. A landscape light comprising:

a support, for securing the landscape light to a substrate;

a head, comprising:

a body;

a light source secured to the body, the light source for emitting light along a direction of light emission;

a cover secured to the body, the cover for covering the light source and allowing transmission of at least a portion of a light generated by the light source; and a first adjustment member secured to the body;

an adaptor, comprising:

a stem being removably securable to the support, the stem comprising a first end being capped, a second end opposite the first end, and a hollow core extending from the first end to the second end, the stem further comprising an opening in the first end for allowing passage of a wire into the hollow core, the stem being shaped and sized to be removably securable to the support and to one or more other supports for securing the landscape light to one or more other types of substrates different from the substrate; and a second adjustment member secured to the first end of the stem adjacent to the opening such that at least a portion of the opening is non-overlapping with the second adjustment member, the second adjustment member removably securable to the first adjustment member in a plurality of positions for adjusting a tilt angle between the head and the support, each of the plurality of positions corresponding to a different tilt angle between the head and the support; and a fastener for removably fastening the first adjustment member to the second adjustment member at each of the plurality of positions.

2. The landscape light of claim 1, wherein:

the first adjustment member comprises a first set of teeth arranged along a first arc of a first circle of a given radius, the first circle defining a first plane about parallel to the direction of light emission, and the first set of teeth extending in a first direction about perpendicular to the direction of light emission; and the second adjustment member comprises a second set of teeth arranged along a second arc of a second circle of the given radius, the second circle defining a second plane about parallel to a longitudinal axis of the stem, and the second set of teeth extending in a second direction about perpendicular to the longitudinal axis of the stem;

the first set of teeth for matingly engaging the second set of teeth at each of the plurality of positions, the first arc overlying at least a portion of the second arc during the mating engagement.

3. The landscape light of claim 2, wherein:

the fastener comprises a screw;

the first adjustment member defines an adjustment member cavity positioned at about a center of the first circle and opening in the first direction, the adjustment member cavity being threaded for matingly receiving the screw; and the second adjustment member defines an aperture positioned at about a center of the second circle, the aperture for allowing passage of the screw.

4. The landscape light of claim 1, wherein:

the stem comprises a threaded end; and the support defines a support cavity being threaded, the support cavity for matingly receiving the threaded end of the stem for removably securing the adaptor to the support.

5. The landscape light of claim 1, wherein:

the support comprises a spike for being driven under pressure into the substrate, the spike shaped to secure the support in the substrate.

6. The landscape light of claim 1, wherein:

the support comprises an anchor for being embedded into a hardenable substrate of hardenable material having a soft state and a hardened state while the hardenable substrate is in the soft state, the anchor shaped to permanently secure the support in the hardenable substrate after the hardenable substrate achieves the hardened state.

7. The landscape light of claim 1, wherein:

the support comprises a base securable to the substrate using a fastener.

8. The landscape light of claim 1, wherein:

the landscape light further comprises the wire for connecting the light source to a power source external to the landscape light; and the hollow core is for allowing passage of the wire.

9. The landscape light of claim 4, wherein:

the landscape light further comprises the wire for connecting the light source to a power source external to the landscape light; and the support comprises a passage for allowing passage of the wire, the passage comprising a cut-put from a portion of the support, the cut-out abutting the support cavity.

10. The landscape light of claim 1, wherein:

the light source comprises one or more light emitting diodes.

11. The landscape light of claim 1, wherein:

the body comprises a heat sink for dissipating heat generated by the light source into an environment external to the landscape light.

12. The landscape light of claim 11, wherein:

the heat sink comprises a plurality of fins about parallel to the direction of light emission, the plurality of fins formed integrally with the body.

13. The landscape light of claim 1, further comprising:

a hat securable to the body, the hat for shaping the light emitted by the light source by blocking propagation of the light radially to the direction of light emission, the blocking being asymmetrical about the direction of light emission.

14. The landscape light of claim 1, wherein the opening has an area smaller than a cross-sectional area of the hollow core at the first end.

15. A landscape light kit comprising:

a head, comprising:

a body;

a light source secured to the body, the light source for emitting light along a direction of light emission;

a cover secured to the body, the cover for covering the light source and allowing transmission of at least a portion of a light generated by the light source; and a first adjustment member secured to the body;

an adaptor, comprising:

a stem being removably securable to a support for securing the landscape light to a substrate, the stem comprising a first end being capped, a second end opposite the first end, and a hollow core extending from the first end to the second end, the stem further comprising an opening in the first end for allowing passage of a wire into the hollow core, the stem being shaped and sized to be removably securable to the support and to one or more other supports for securing the landscape light to one or more other types of substrates different from the substrate; and a second adjustment member secured to the first end of the stem adjacent to the opening such that at least a portion of the opening is non-overlapping with the second adjustment member, the second adjustment member removably securable to the first adjustment member in a plurality of positions for adjusting a tilt angle between the head and the support, each of the plurality of positions corresponding to a different tilt angle between the head and the support;

a fastener for removably fastening the first adjustment member to the second adjustment member at each of the plurality of positions; and any two or more of:

a spike support comprising a spike for being driven under pressure into the substrate, the spike shaped to secure the support in the substrate;

an embeddable support comprising an anchor for being embedded into a hardenable substrate of hardenable material having a soft state and a hardened state while the hardenable substrate is in the soft state, the anchor shaped to permanently secure the support in the hardenable substrate after the hardenable substrate achieves the hardened state; and a fastenable support comprising a base securable to the substrate using a fastener.

16. The landscape light kit of claim 15, further comprising:

a hat securable to the body, the hat for shaping the light emitted by the light source by blocking propagation of the light radially to the direction of light emission, the blocking being asymmetrical about the direction of light emission.

* * * * *